US005816965A

United States Patent [19]

Kotler

[11] Patent Number: 5,816,965

[45] Date of Patent: Oct. 6, 1998

[54] HOCKEY PUCK

[76] Inventor: Daniel Kotler, 2102 E. 3300 South, Salt Lake City, Utah 84109

[21] Appl. No.: 883,382

[22] Filed: Jun. 26, 1997

[51] Int. Cl.[6] ..... A63B 71/00

[52] U.S. Cl. ..... 473/588

[58] Field of Search ..... 473/588, 589; 84/304; 403/292, 298; 348/157

[56] References Cited

U.S. PATENT DOCUMENTS

| | | | |
|---|---|---|---|
| 2,226,516 | 12/1940 | Ross | 473/588 |
| 2,727,744 | 12/1955 | Watson | 473/588 |
| 3,726,526 | 4/1973 | Radovich | 473/588 |
| 3,784,204 | 1/1974 | Felber | 473/588 |
| 3,944,738 | 3/1976 | Johnson | 348/157 |
| 4,320,984 | 3/1982 | Mayer et al. | 403/292 |
| 4,526,068 | 7/1985 | Undin et al. | 81/9.4 |
| 5,014,990 | 5/1991 | Kaser et al. | 473/588 |
| 5,275,410 | 1/1994 | Bellehumeur et al. | 473/588 |
| 5,284,343 | 2/1994 | Bigornia et al. | 473/588 X |
| 5,518,237 | 5/1996 | Bellehumeur | 473/588 |
| 5,597,161 | 1/1997 | Bellehumeur et al. | 473/588 |
| 5,692,981 | 12/1997 | Whisman | 473/588 |

*Primary Examiner*—Raleigh W. Chiu
*Attorney, Agent, or Firm*—Thorpe, North & Western, LLP

[57] ABSTRACT

A hockey puck with locking runners of various shapes is self-orienting and highly visible. The puck has runners with notches disposed in holes with protrusions such that the notches and protrusion mate, locking the runners in the puck and aligning the runners in the holes. The puck has a perimeter side wall with a radius of curvature such that the puck self-orients to a horizontal orientation when it rises up on its side. The puck also has a protrusion formed on the side wall that forces the puck into a precessing motion pattern such that the puck self-orients to a horizontal orientation when rolling on its side. The runners may have a portion that extends through the curved perimeter wall past an edge of the puck to prevent the edge from catching on the playing surface and flipping the puck. An indentation is formed in each of a upper and lower surfaces of the puck. The indentations have an interior side wall and bottom wall defining a primary and secondary visible surface respectively. A reflective material is disposed on the visible surface such that the puck is easier to see.

19 Claims, 7 Drawing Sheets

HOCKEY PUCK

BACKGROUND OF THE INVENTION

1. Field of the Invention

The present invention relates to a self-orienting and highly visible hockey puck with locking runners of various shapes for playing ice or roller hockey. More particularly, the present invention relates to a hockey puck having a curved perimeter wall for re-orienting the puck horizontally when rolling on its side; conical indentations creating an angled reflective surface to make the puck more visible; runners with locking notches disposed in holes with mating locking protrusions to retain the runners within the puck; runners extending through the curved perimeter wall to prevent flipping; and runners of various cross-sections to alter the performance and motion characteristics of the puck.

2. Prior Art

The game of ice hockey or roller hockey, is a popular sport played by many people from young children to professional athletes. Hockey is typically played on enclosed rinks by attempting to shoot a puck through a goal located at either end of the rink, known as a cage. The players wear skates and strike the puck with a stick in order to move it across the rink and into the cage. Because the puck typically travels with great speed, the players wear padding to protect themselves from being injured if struck by the puck. During play, the puck is often passed by ricocheting or banking the puck off a dasher board that surrounds the rink. Because accurately passing or shooting the puck with the stick requires a great degree of skill, it is common for the puck to miss the goal or leave the rink surface and travel above the dashboard. Therefore, a protective safety glass barrier surrounds the rink atop the dasher board to prevent the puck from leaving the rink and striking spectators.

The puck usually has a disk shaped body with an upper and lower horizontal surface and a cylindrical perimeter wall. The puck is usually made of a high density material having low friction properties so that it may slide across the playing surface. Therefore, the puck is exceptionally hard. The hardness of the puck, coupled with the high force and general inaccuracy with which it is struck, leads to serious player and spectator injury despite the player's protective gear and the protective safety glass barrier. The hard puck frequently breaks the protective safety glass barrier and is responsible for many missing teeth, which has become the signature of hockey.

In an attempt to soften the painful and damaging consequences of the hard puck, a less dense material, such as vinyl has been used to make the pucks. This softer material usually results in a higher friction between the playing surface and the puck, which results in sluggish, atypical performance. Therefore, higher density, lower friction inserts, or runners, have been developed.

The runners are inserted into the puck body and protrude from the surface of the puck. The runners have cylindrical bodies and spherical ends for contacting the playing surface. The runners provide a low friction surface on which the puck may slide while maintaining the softer material for body.

One problem with runners is their effect on the performance characteristics of the puck. Because the contacting surface of the puck has been reduced from the entire surface of the puck to the significantly smaller surface of the runners, the runners wear quickly and must be replaced. The runners also have an effect on performance as the puck now travels on the several spherical ends of the runners as opposed to the broad, flat surface of the puck. The runners have a greater tendency to be affected by surface irregularities in the skating rink. This tendency is enhanced as the runners wear and the spherical ends of the runners are worn to a more blunt, cylindrical shape. This change in performance may be viewed as either a substandard deviation and pollution of the sport, or a variable adding character and making the game more interesting.

Another problem with the runners is the difficulty of removing a worn runner and the tendency of the runners to inadvertently fall out. The runners are held in the puck by friction or a press fit. As the puck is struck, the force sometimes dislodges a runner, altering the performance characteristics of the puck and often loosing the runner. In addition, once a runner is worn, it is difficult to get out. The runner may be grasped by pliers or another tool and pulled from the puck before it has become completely worn. But this requires frequent runner replacement and is wasteful. If the runners are allowed to completely wear, there is not enough runner protruding from the puck to grasp with a tool.

Another problem with the runners and puck is the tendency of the puck to flip because the puck body is raised off the playing surface by the runners. When the puck is struck by the hockey stick, the rear end of the puck tends to rise while the forward end dips. When the forward end dips, the edge of the puck body catches on the playing surface, causing the puck to flip or tumble.

Another problem with the puck is visibility. Although the puck is typically made of a contrasting color as compared to the playing surface, it is still difficult to see due to the high rate of speed at which it travels. This is a problem for both players and spectators and is especially acute for television viewers as the puck is not only difficult to follow by the cameraman but is reduced in size and distinction by the television equipment.

Another problem with the traditional puck is its tendency to deviate from the intended horizontal orientation. As the puck is struck and batted about, it inevitably changes orientation, often rising up or rolling on its side. This vertical orientation or rolling is undesirable as the game was designed for a sliding puck.

Roller hockey is similar to ice hockey except that it is not played on ice. Roller hockey is usually played on another surface, such as modular, plastic, interlocking tile floor positioned on an asphalt or cement floor, or other support surface. Rather than wearing ice skates, the players wear roller skates, in-line skates, or no skates at all. A different puck is used as well, such as pucks having low friction surfaces that slide well on pavement and plastic tile courts. Some of these pucks make use of runners. Roller hockey pucks also suffer from many of the problems identified above with hockey pucks, namely dislodged runners, irremovable runners, flipping, low visibility, and changing orientation. These hockey surfaces also contain irregularities, such as cracks between tiles and depressions in the surfaces that combine with the runners to alter the performance of the puck.

Therefore, it would be advantageous to develop a runner capable of locking into the puck. It would also be advantageous to develop a runner capable of changing various performance characteristics of the puck. It would also be advantageous to develop a puck that resists flipping. It would also be advantageous to develop a puck with greater visibility. In addition, it would be advantageous to develop a puck capable of self-orientation.

OBJECTS AND SUMMARY OF THE INVENTION

It is an object of the present invention to provide a runner for roller hockey pucks that locks into place.

It is another object of the present invention to provide a runner for hockey pucks that alters the performance characteristics of the puck.

It is yet another object of the present invention to provide a hockey puck and runners with mating locking notches and protrusions to hold the runners in place.

It is yet another object of the present invention to provide a hockey puck that resists flipping.

It is yet another object of the present invention to provide a hockey puck with runners having a portion extending through the perimeter wall to prevent the edge of the puck body from catching the surface and flipping.

It is yet another object of the present invention to provide a hockey puck that is more visible.

It is yet another object of the present invention to provide a hockey puck with indentations on the surfaces to create an angled, reflective surface that is more visible.

It is yet another object of the present invention to provide a hockey puck that is self-orienting.

It is yet another object of the present invention to provide a hockey puck with a non-cylindrical perimeter side wall so that the puck is self-orienting.

It is yet another object of the present invention to provide a hockey puck that is less likely to roll.

It is a further object of the present invention to provide a hockey puck with a small protrusion on the perimeter side wall so that the puck is less likely to roll.

These and other objects and advantages of the present invention are realized in a hockey puck having locking runners; runners of various shapes; a curved side wall with a protrusion; runners with a portion extending through the side wall; and an indentation with an angled, reflective surface. The puck has a circular, disc shaped puck body with upper and lower parallel surfaces, a thickness, a center of mass, a longitudinal axis, and a perimeter side wall. A plurality of holes extend through the puck body and are located equidistance from the longitudinal axis and each other. A plurality of runners are disposed in the holes. The runners have a notch formed at the midpoint that mate with a protrusion formed at the midpoint of the holes. The notch and protrusion lock the runners in place and align the runners within the holes.

The runners and holes may have various shapes, such as circular, elliptical, square, diamond, star, triangular, or polygonal. The various shapes provide for various forms of interaction between the puck and a playing surface, thus altering the performance characteristics of the puck.

The perimeter side wall of the puck has a radius of curvature with respect to the center of mass. The curved side wall causes the puck to self-orient to a horizontal location when the puck changes orientation and rises up on its side. In addition, a protrusion is formed on the side wall that forces the puck into a precessing movement pattern so that the puck self-orients to a horizontal location when the puck changes orientation and rolls on its side.

The holes and runners may have a portion extend through the curved perimeter side wall. This locates a portion of the runners past an edge of the puck body so that the edge is prevented from catching on the surface and flipping.

An indentation is formed in each of the upper and lower surfaces. The indentations have an interior side wall and a bottom wall defining a primary and secondary visible surfaces respectively. A reflective material is disposed on the visible surfaces so that the puck is easier to see. The reflective material may reflect light, be florescent, glow, or interact with a light source to make the puck stand out.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
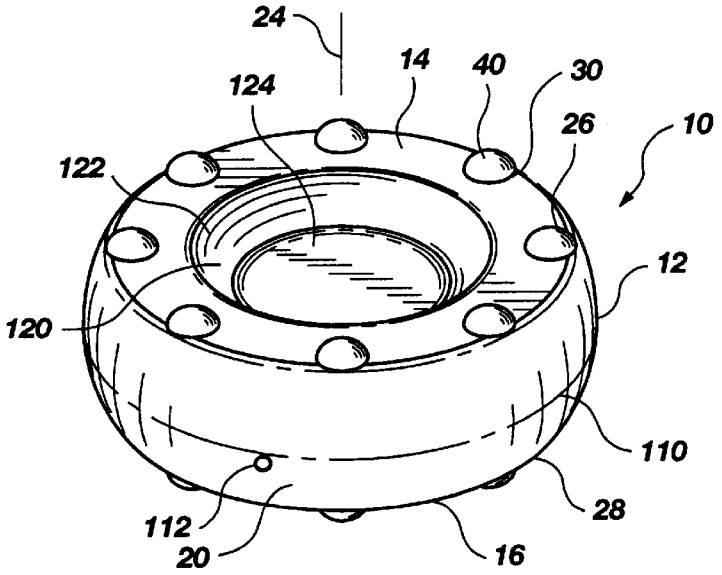
FIG. 1 is a perspective view of a preferred embodiment of a hockey puck of the present invention.
Figure 2:
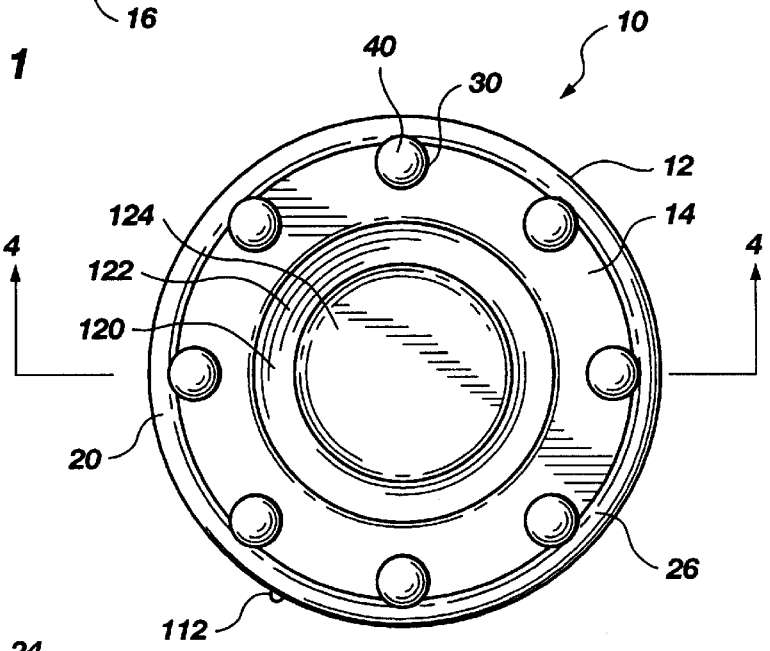
FIG. 2 is a top view of a preferred embodiment of the hockey puck of the present invention.
Figure 3:
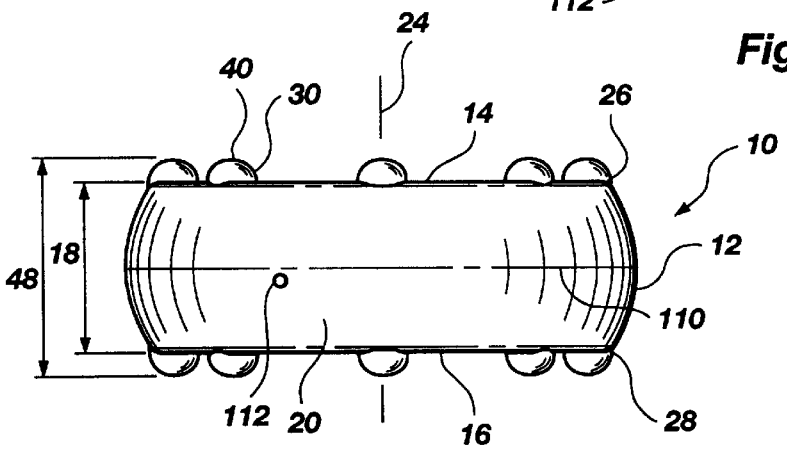
FIG. 3 is a front elevational view of preferred embodiment of the hockey puck of the present invention.
Figure 4:
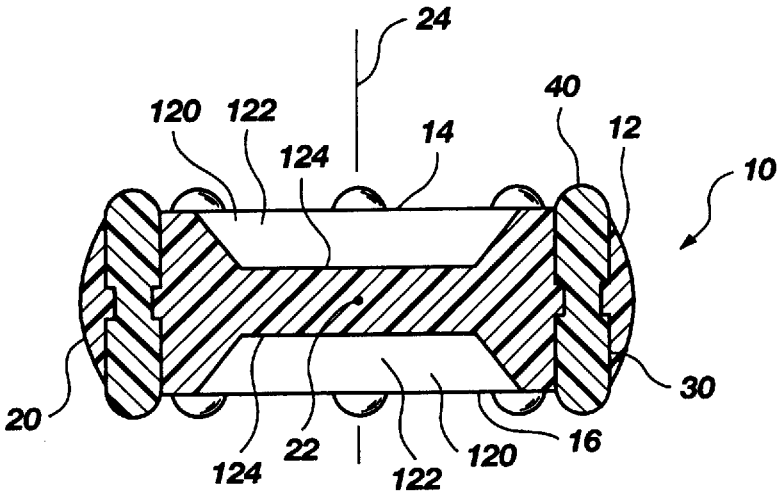
FIG. 4 is a cross section view of a preferred embodiment of the hockey puck of the present invention taken along line 4—4 of FIG. 2.

As illustrated in FIGS. 1–4, a hockey puck 10 of the present invention is shown. The hockey puck 10 has a circular, disc-shaped puck body 12. The puck body 12 has an upper surface 14 and a lower surface 16 in parallel relationship with the upper surface 14. The puck body 12 has a thickness 18 defined by the upper and lower surfaces 14 and 16, as shown in FIG. 3. The puck body 12 has a perimeter side wall 20. The puck body 12 has a center of mass 22, as shown in FIG. 4, and a longitudinal axis 24 perpendicular with the upper and lower surfaces 14 and 16. An upper and lower edge 26 and 28 are formed where the perimeter side wall 20 between the upper and lower surfaces 14 and 16 respectively.

The puck body 12 is preferably made of a low density material, such as vinyl. A low density material is softer and less likely to damage the rink or injure a player.

Figure 5:
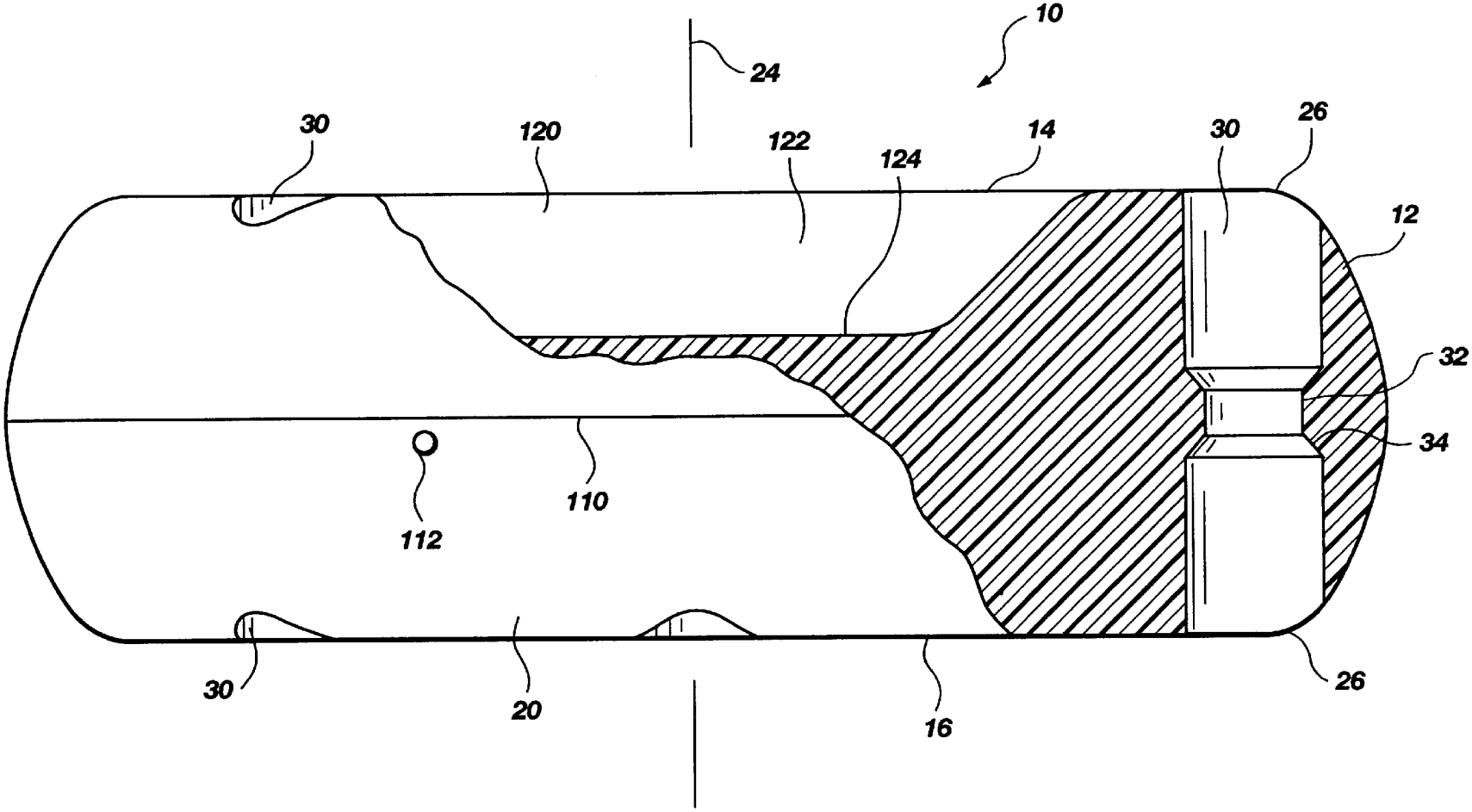
FIG. 5 is a side elevational view, partially cut away, of a preferred embodiment of a puck body of the present invention.

Referring to FIG. 5, the puck body 12 has a plurality of holes 30 extending through the puck body 12 from the upper surface 14 to the lower surface 16. Referring to FIG. 2, the holes 30 are located circumferentially about the longitudinal axis 24 near the perimeter side wall 20. The holes 30 are preferably spaced equidistance from the longitudinal axis 24 or perimeter side wall 20. Alternatively, the holes 30 may be alternated with some holes located closer to the side wall than others. In addition, the holes 30 are preferably spaced equidistance from one another. Alternatively, the holes 30 may be grouped together, such as in pairs.

Referring again to FIG. 5, a protrusion 32 is formed in each of the holes 30 at a location generally midway between the upper surface 14 and the lower surface 16. In the preferred embodiment, the holes 30 are cylindrical and the protrusion 32 is an annular ridge. A taper 34 may be formed on the protrusion 32.

Referring again to FIGS. 1–4, a plurality of runners 40 are disposed in the holes 30. Because of the location of the holes 30, the runners 40 are located equidistance from the longitudinal axis 24 and perimeter side wall 20 and are equidistance from each other, as shown in FIG. 2. Alternatively, the holes 30 and runners 40 may be alternated with some being closer to the side wall, or may be grouped together.

Figure 6:
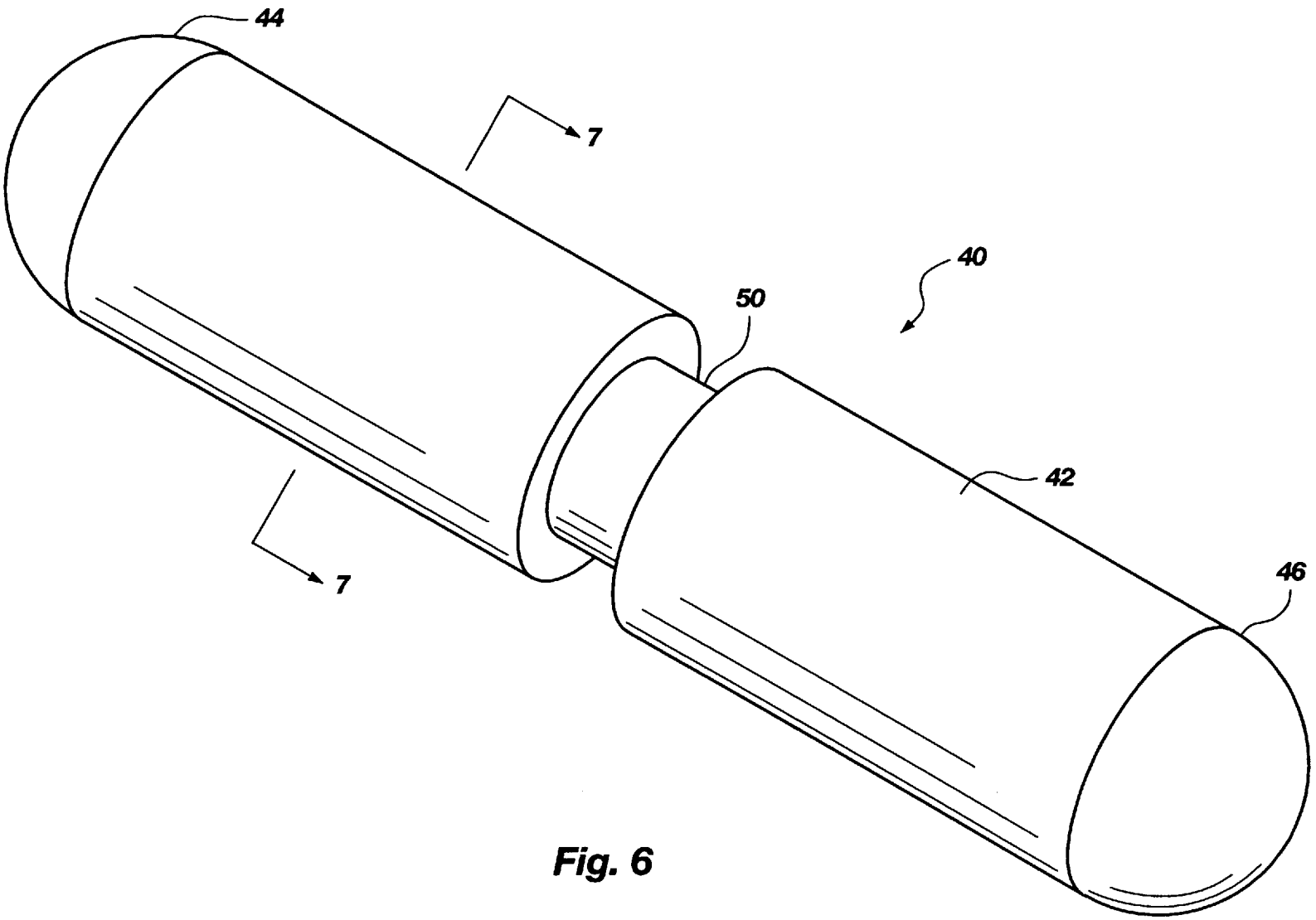
FIG. 6 is a perspective view of a preferred embodiment of a runner of the present invention.

As illustrated in FIG. 6, the runners 40 have a straight, elongated runner body 42. The runner body 42 has a first end 44 and a second end 46. The runner ends 44 and 46 are preferably rounded. The runner body 42 has a length 48 greater than the thickness 18 of the puck body 12, as shown in FIG. 3, so that the ends 44 and 46 protrude from the surfaces 14 and 16 of the puck.

The runner body 42 is preferably made of a high density material such as nylon, Delron, or Teflon™. The high density material has low friction properties allowing the puck 10 to slide across a playing surface on the runner ends 44 and 46.

A notch 50 is formed in the runner body 42 at a location generally midway along the length 48 of the runner body 42. The notch 50 mates with the protrusion 32 formed in the puck body 12, as shown in FIG. 4. In the preferred embodiment, the runners 40 are cylindrical and the notch 50 is an annular groove. A taper may be formed on the notch 50 that matches the taper 34 on the protrusion 32.

It is of course understood that the protrusion may be formed on the runners and the notch be formed in the holes. For manufacturing purposes, specifically injection molding, it is preferable that the protrusion be formed in the holes and the notch formed in the runners. In addition, the protrusions and notches need not be formed at a midpoint, but may be located at any desired location.

The protrusion 32 and notch 50 advantageously retain and align the runners 40 in the holes 30. Therefore, the runners are locked in the puck and prevented from inadvertently falling out of the holes. In addition, the runners are prevented from becoming misaligned when struck.

Because the runners 40 extend through the puck body 12, they may be easily replaced when worn by pressing on one end 44 or 46 of the runner, forcing it through the hole 30 and out of the puck body 12. In addition, a new runner may be easily inserted by pressing the runner into and through the hole until the notch mates with the protrusion, thus locking the runner in place and aligning it with the puck body. The taper 34 on the protrusion 32 and the rounded end 44 or 46 of the runner help force the runner body 42 past the protrusion 32 when inserting a new runner 40. A taper on the notch 50 and the taper 34 on the protrusion 32 help force the runner body 42 past the protrusion 32 when removing a worn runner. The notch and protrusion are a significant improvement over prior art pucks and runners where the runners are press fit into the puck and may become misaligned or knocked loose when struck by providing locking, self-aligning runners.

In the preferred embodiment, runners 40 and holes 30 are cylindrical, or have a circular cross-section, as described above. In addition, the ends 44 and 46 of the runners 40 are preferably rounded, or spherical. In this way, the rounded ends 44 and 46 and cylindrical runners 40 present a uniform geometry that contacts the playing surface in a manner that reduces friction as much as possible. In different circumstances, it may be desirable to play with a puck that has different performance characteristics. Runners 40 of various cross-sections may be used to alter the performance characteristics of the puck, as shown in FIGS. 7*a*–7*g*. Although the rounded ends 44 and 46 of the runners 40 are the primary contact between the puck and the playing surface, the side of the runners begins to interact with the playing surface as the runners become worn.

Figure 7A:
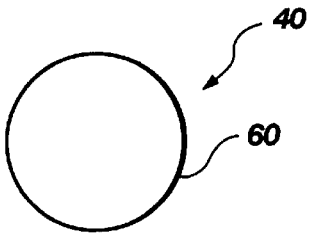
FIG. 7*a* is a cross section view of a preferred embodiment of a runner of the present invention taken along line 7—7 of FIG. 6.

As illustrated in FIG. 7*a,* the runner 40 is shown with a circular cross-section 60. The circular cross-section has a uniform side or perimeter for interacting with the playing surface. In other words, the puck may be spun or slid in any direction with the circular shape of the runner having the least amount of interference with puck performance. The runner with a circular cross-section is presently considered to present the least friction resistance between the playing surface and the puck. Runners with non-circular cross-sections may be used, however, to change the interaction between the puck and the playing surface, as shown in FIGS. 7*b*–7*g*.

Figure 7B:
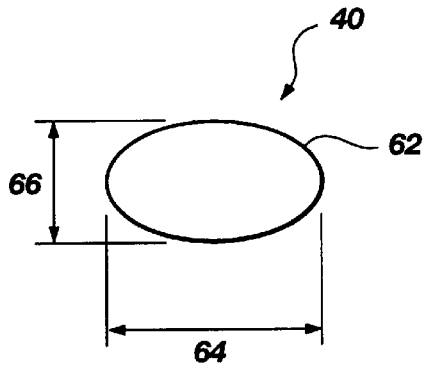
FIG. 7*b* is a cross section view of an alternative embodiment of a runner of the present invention.
Figure 8A:
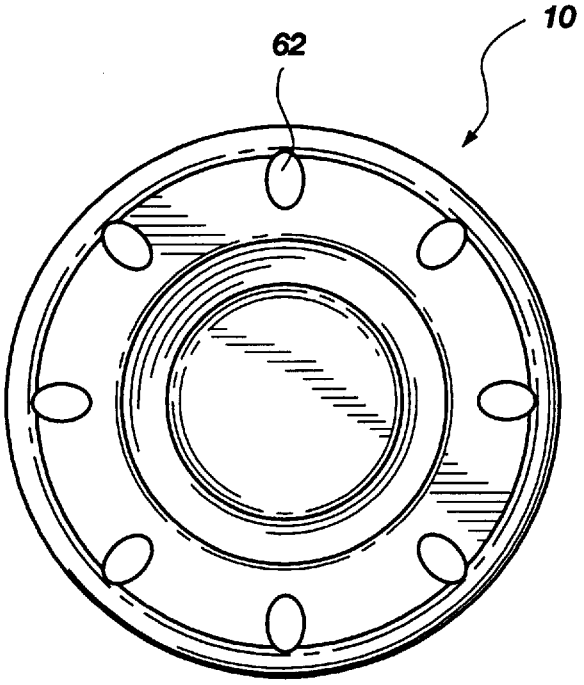
FIG. 8*a* is a top view of an alternative embodiment of a runner configuration and orientation of the present invention.
Figure 8B:
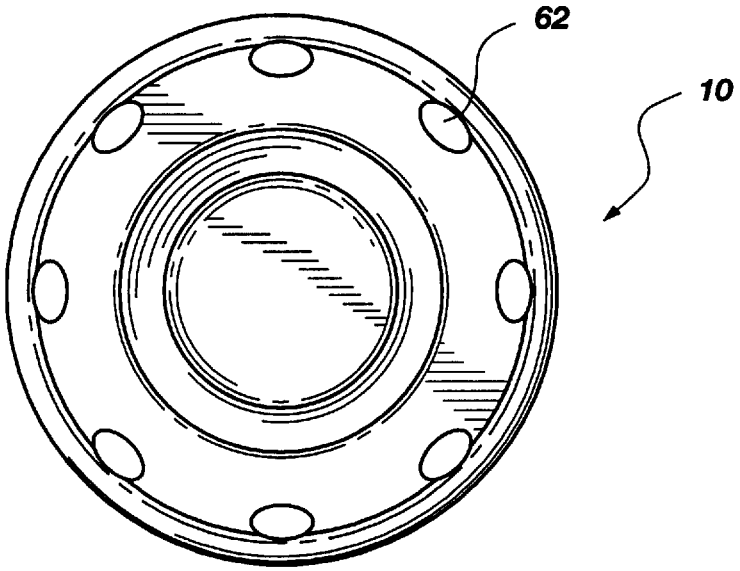
FIG. 8*b* is a top view of an alternative embodiment of a runner configuration and orientation of the present invention.

Referring to FIG. 7*b,* the runner 40 may have an elliptical cross-section 62. The elliptical cross section 62 has a major diameter 64 and a minor diameter 66. The elliptical cross-section 62 may be oriented to influence the interaction between the surface and the runner. For example, the major diameter 64 may be oriented radially outward form the longitudinal axis 24 of the puck body 12, and the minor diameter 66 may be oriented circumferentially about the longitudinal axis 24, as shown in FIG. 8*a.* In this way, the major diameter 66 of the runner 40 presents a broader surface area and thus a greater frictional resistance to spinning. Alternatively, the major diameter 64 may be oriented circumferentially about the longitudinal axis 24 of the puck body 12 and the minor diameter 66 may be oriented radially outward from the longitudinal axis 24, as shown in FIG. 8*b.* In this way, the minor diameter 66 presents a narrower surface area and thus a lesser frictional resistance to spinning.

Figure 7C:
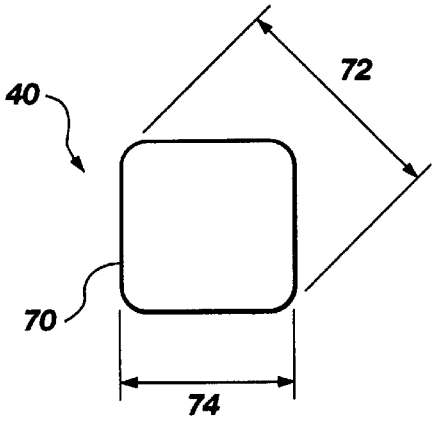
FIG. 7*c* is a cross section view of an alternative embodiment of a runner of the present invention.
Figure 7D:
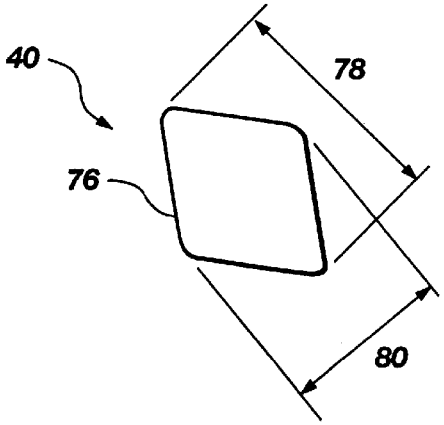
FIG. 7*d* is a cross section view of an alternative embodiment of a runner of the present invention.

Referring to FIGS. 7*c* and 7*d,* the runners 40 may have a parallelogram-shaped cross-section. The runners 40 may have a square cross-section 70 with a major diameter 72 and a minor diameter 74, as shown in FIG. 7*c.* Alternatively, the runners 40 may have a diamond cross-section 76 with a major diameter 78 and a minor diameter 80. The major and minor diameters of the runners with parallelogram-shaped cross-sections may be oriented in a similar manner as the elliptical cross-sections shown in FIGS. 8*a* and 8*b*. In addition, rather than rounded ends, the parallelogram-shaped cross-sections may have pointed ends, thus creating ends with a pyramid-shaped geometry. The pointed ends have a greater tendency to catch in inconsistencies in the playing surface.

Figure 7E:
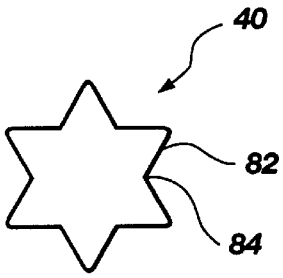
FIG. 7*e* is a cross section view of an alternative embodiment of a runner of the present invention.

Referring to FIG. 7*e*, the runners 40 may have a star-shaped cross-section including a six-pointed star 82. Stars of various configuration may be used, but the six-pointed star is considered preferably because its symmetry provides for ease of manufacturing, such as injection molding. The star-shaped cross-section presents a surface with internal corners 84 that may interact with the playing surface by catching on flaws in the playing surface and thus alter the movement of the puck.

Figure 7F:
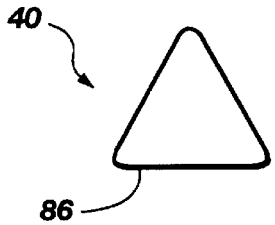
FIG. 7*f* is a cross section view of an alternative embodiment of a runner of the present invention.

Referring to FIG. 7*f*, the runners 40 may have a triangular-shaped cross-section 86. The triangular-cross section 86 may be oriented so that either the point, or two angled surfaces, faces a desired rotation or direction of travel while the blunt edge faces a non-desirable rotation or direction of travel. Like the parallelogram-shaped cross-sections, the triangle-shaped cross-section may have pointed ends, thus creating pyramid-shaped ends.

Figure 7G:
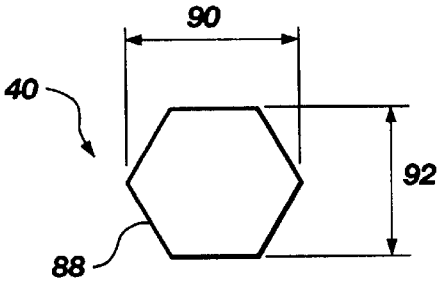
FIG. 7*g* is a cross section view of an alternative embodiment of a runner of the present invention.

Referring to FIG. 7*g*, the runners 40 may have any polygon-shaped cross-section 88. The polygon-shaped cross-section 88 has a major diameter 90 and a minor diameter 92.

It is of course understood that the runners may be oriented in any manner, including varying or altering the orientation of the runners. In addition, the runners may be located at various or altering locations in the puck body. Although the runners are shown as aligned with the longitudinal axis of the puck body, the runners may be disposed in the puck body at angles with respect to the longitudinal axis.

The non-circular runners advantageously have various geometries for achieving various performance characteristics. Broad surfaces may be oriented to oppose an undesired direction of travel while narrow surfaces may be oriented towards desired directions of travel. In addition, indentations may be provided to interact with inconsistencies or irregularities in the playing surface.

The non-circular runners provide a significant improvement over circular runners by providing a runner than may change the performance characteristics of the puck, such as interacting with playing surface irregularities to alter the direction of travel or making the puck more or less likely to spin.

As illustrated in FIGS. 1–5, the puck body 12 has the perimeter side wall 20. The perimeter side wall 20 has a radius of curvature 100 with respect to the center of mass 22 of the puck body 12, as shown in FIG. 4. The radius of curvature 100 of the perimeter side wall 20 causes the puck body 12 to self-orient to a horizontal position when the perimeter side wall contacts the playing surface. Thus, if the puck 10 is placed on its side, or on the side wall 20, it will topple over into the proper horizontal orientation.

Figure 12:
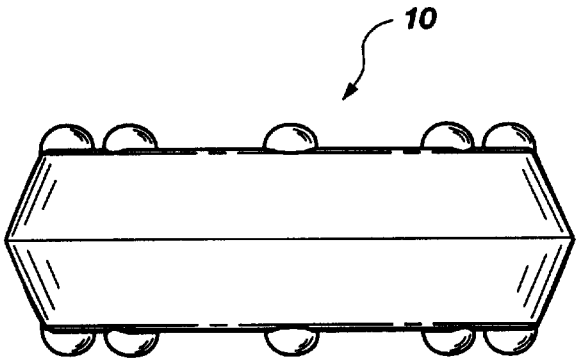
FIG. 12 is a front elevational view of an alternative embodiment of a hockey puck of the present invention.

It is of course understood that the perimeter side wall 20 may be shaped in various other ways to cause the puck to self-orient. For example, the puck body 12 may be formed of two opposing frustums joined together at their bases, as shown in FIG. 12. Thus, the perimeter side wall has two angled surfaces rather than a radius of curvature.

The non-flat perimeter side wall advantageously causes the puck to self-orient to a horizonal orientation.

Although the game is designed to be played with the puck in a horizontal orientation, the puck inevitably changes orientation and rises up on its side. Prior art pucks have flat side walls which allows them to rise up on their sides because the center of mass is located above a side of the puck in contact with the playing surface. The radius of curvature 100 on the perimeter side wall 20 of the puck of the present invention presents a significant improvement over prior art pucks because the curved side causes the puck to self-orient to a horizontal position. Because of the curved side, the center of mass 22 is located above a side not in contact with the playing surface, thus causing the puck to topple into the proper, horizontal orientation.

As described above, the puck body 12 has a center of mass 22. A center plane (not shown) may be defined as intersecting the center of mass 22 and being parallel with the upper and lower surfaces 14 and 16 of the puck body 12. Thus, the center plane is generally located at a midpoint between the upper and lower surfaces 14 and 16. This center plane intersects the perimeter side wall 20, defining a perimeter center line 110, as shown in FIGS. 1, 3, and 5. This perimeter center line 110 is generally located at a midpoint between the upper and lower surfaces 14 and 16.

At least one protrusion 112 is formed on the perimeter side wall 20. The protrusion 112 is preferably located off the center line 110. The protrusion 112 is small, having a nominal mass compared to the mass of the puck body 12. The protrusion does not interfere with the balance of the puck because of its nominal mass and does not interfere with the interaction between the puck and hockey stick because of its small size. The protrusion 112 projects outward from the puck body 12 a sufficient distance to thrust the puck body 12 into a precessing movement pattern when the puck rolls on its side. The precession of the puck body causes the puck to self-orient to a horizontal position when the perimeter side wall 20 of the puck body 12 and the protrusion 112 are in moving contact with the playing surface. Therefore, when the puck changes orientation and rolls on its side, the protrusion 112 causes the puck to precess. The precession movement pattern causes the puck to self-orient to a horizontal orientation.

It is of course understood that the puck may be provided with any number of protrusions located in various locations and configurations. For example, one protrusion may be located on a lower half of the side wall while another is located on an upper half of the side wall diametrically opposed to the first.

The puck tends not only to change orientation and rise up on its side, but more commonly tends to roll on its side. Prior art pucks tend to roll indefinitely due to their flat, circular shape. The present invention presents a significant improvement over prior art pucks that tend to roll by providing a protrusion that causes the puck to precess and self-orient.

Referring again to FIG. 5, the holes 30 are preferably located so that the holes 30 extend not only through the upper and lower surfaces 14 and 16 of the puck body 12, but through a portion of the perimeter side wall 20 as well. In this way, the runners 40 extend not only through the upper and lower surfaces 14 and 16, but through the perimeter side wall 20 as well. Referring to FIGS. 1–4, the runners 40 are also located so that a portion of the runners is past the edges 26 of the puck. Thus, the runners 40 prevent the edges 26 of the puck from catching on the playing surface and flipping the puck. In addition, the runners 40 act as additional protrusions on the side wall and tend to cause a precessing movement pattern along with the protrusion 112.

Pucks tend to flip when stuck with a hockey stick. The forward runners act as a pivot point so that when the puck is struck, the rear of the puck rises while the front of the puck dips. The edge of the puck catches on the playing surface and the puck flips or tumbles. This is undesirable as the game is designed to be played with a sliding puck. The present invention provides a significant improvement over prior art pucks that tend to flip by locating a portion of the runners so that they extend through the curved side wall of the puck and past the edges to prevent the edge from catching on the surface and flipping the puck.

Referring again to FIGS. 1–2 and 4–5, the puck body 12 has an indentation 120 formed in each of the upper and lower surfaces 14 and 16. The indentations 120 preferably have a center axis collinear with the longitudinal axis 24 of the puck body 12. Thus, the indentation is centered in the surface. The indentations have an interior side wall 122 defining a primary visible surface that is at an acute angle of view with respect to the longitudinal axis 24. In addition, the indentations 120 preferably have a bottom wall 124 defining a secondary visible surface. The indentations 120 are preferably conically shaped. A reflective material 126 is disposed on the visible surfaces 122 and 124. The reflective material 126 reflects light making the puck more visible. The reflective material 126 may be a sticker, paint, or the puck may be made of the same reflective material. In addition, the reflective material may be a florescent color or a glow-in-the-dark material.

The visible surfaces 122 and 124 and the reflective material 126 may be used in conjunction with a light source. For example, bright lights may be positioned overhead to reflect on the reflective material 126. In addition, special colored lights may be used with a reflective material of a special color such that the reflective material appears to glow, or stand out.

Figure 11A:
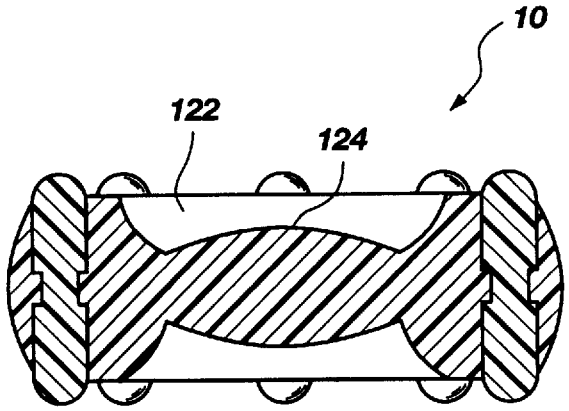
FIGS. 11*a* & 11*b* represent a cross section view of an alternative embodiment of a hockey puck taken along line 11—11 of FIG. 10.
Figure 11B:
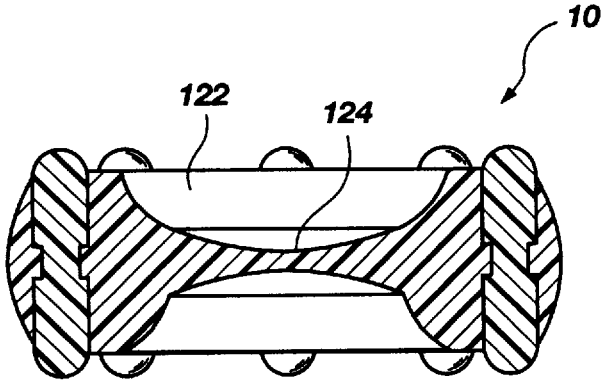
Figure 9:
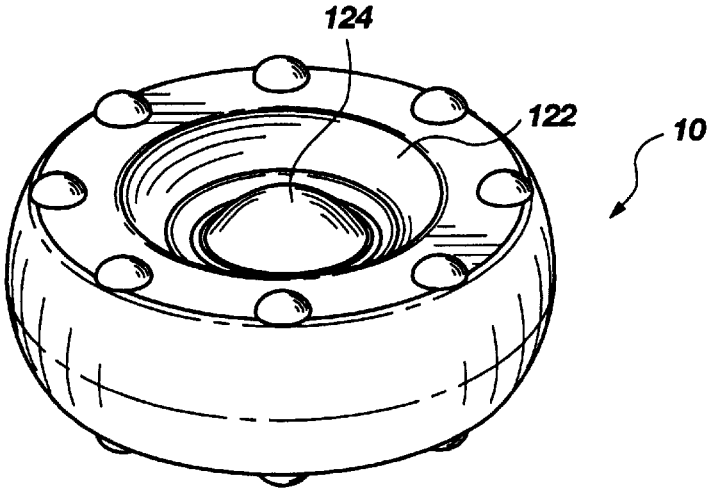
FIG. 9 is a perspective view of an alternative embodiment of a hockey puck of the present invention.
Figure 10:
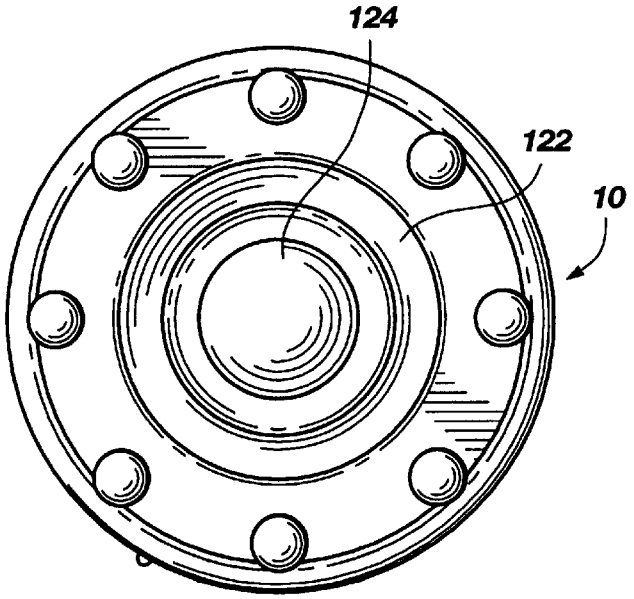
FIG. 10 is a top view of an alternative embodiment of a hockey puck of the present invention.

Referring to FIGS. 11*a* and 11*b*, the interior side wall 122 and bottom wall 124 of the indentation 120 may be concave or convex. The interior side wall 122 may be concave, as shown on the upper part of the puck in FIGS. 11*a* and 11*b*. Alternatively, the interior side wall 122 may be convex, as shown on the lower part of the puck in FIGS. 11*a* and 11*b*. Likewise, the bottom wall 124 may be convex, as shown in FIGS. 9, 10 and 11*a*, or concave, as shown in FIG. 11*b*.

It is of course understood that the indentations may be of any number, shape, and configuration. For example, the indentation may be square or triangular. In addition, one or more indentations may be formed in each surface. Furthermore, the indentation may consist entirely of the interior side wall without a bottom wall.

Therefore, the puck advantageously has indentations with angled, reflective walls that make the puck more visible.

Although the puck is typically made of a contrasting color as compared to the playing surface, it is still difficult to see due to its high velocity. The situation is aggravated for spectators who are located at a greater distance from the puck. Therefore, the angled surface of the indentation and the reflective material help make the puck more visible.

It is to be understood that the described embodiments of the invention are illustrative only, and that modifications thereof may occur to those skilled in the art. For example, the holes, runners, indentations, and protrusions may-be of any number and of various configurations. Accordingly, this invention is not to be regarded as limited to the embodiments disclosed, but is to be limited only as defined by the appended claims herein.

What is claimed is:

1. A hockey puck comprising:

a circular, disc shaped puck body having an upper surface, a lower surface in parallel relationship with the upper surface, a longitudinal axis perpendicular to the upper surface and lower surface, a thickness defined by the upper surface and the lower surface, and a perimeter side wall;

a plurality of holes extending through the puck body from the upper surface to the lower surface, the holes having a protrusion formed in each of the holes at a location generally midway between the upper surface and the lower surface; and a plurality of runners disposed in the holes, each runner having a straight, elongated runner body with a rounded first end, a rounded second end, a length greater than the thickness of the puck body, and a notch formed in the runner body at a location generally midway along the length of the runner body and mating with the protrusion formed in the holes such that the runners are retained and aligned in the holes.

2. The hockey puck of claim 1, wherein the holes and the runners are cylindrical and the notch is an annular groove formed in the runner body and the protrusion is an annular ridge formed in the hole.

3. The hockey puck of claim 1, wherein the holes and the runners have a non-circular cross-section.

4. The hockey puck of claim 3, wherein the holes and the runners have elliptical cross-sections.

5. The hockey puck of claim 4, wherein the elliptical cross-sections have a major diameter and a minor diameter, the major diameter of the holes and the runners being oriented radially outward from the longitudinal axis of the puck body and the minor diameter being oriented circumferentially about the longitudinal axis.

6. The hockey puck of claim 4, wherein the elliptical cross-sections have a major diameter and a minor diameter, the major diameter of the holes and the runners being oriented circumferentially about the longitudinal axis of the puck body and the minor diameter being oriented radially outward from the longitudinal axis.

7. The hockey puck of claim 3, wherein the holes and the runners have a generally star-shaped cross-section.

8. The hockey puck of claim 7, wherein the star-shaped cross-section is a six-pointed star.

9. The hockey puck of claim 3, wherein the holes and the runners have a generally parallelogram-shaped cross-section.

10. The hockey puck of claim 9, wherein the parallelogram-shaped cross-section is a square.

11. The hockey puck of claim 9, wherein the parallelogram-shaped cross-section is a diamond.

12. The hockey puck of claim 3 wherein the holes and the runners have a generally polygon-shaped cross-section.

13. The hockey puck of claim 1, wherein the puck body has a center of mass and wherein the perimeter side wall has a radius of curvature with respect to the center of mass of the puck body such that the puck body tends to self-orient to a horizontal position when the perimeter side wall of the puck body is in contact with a playing surface.

14. The hockey puck of claim 13, wherein the holes and runners are oriented circumferentially about the longitudinal axis and wherein at least a portion of the holes and runners pass through the upper surface, lower surface, and perimeter side wall of the puck body.

15. The hockey puck of claim 1, further comprising:

at least one protrusion having a nominal mass compared to the mass of the puck body and projecting outward from the perimeter side wall a sufficient distance to thrust the puck body into a precessing movement pattern such that the puck body tends to self-orient to a horizontal position when the perimeter side wall of the puck body and protrusion are in moving contact with a playing surface.

16. The hockey puck of claim 1, wherein the body has a center of mass, a center plane intersecting the center of mass and parallel with the upper surface and the lower surface, and a perimeter center line defined by an intersection of the center plane with the perimeter side wall; and wherein the protrusion is located on the perimeter side wall but off the center line.

17. The hockey puck of claim 1, further comprising:

an indentation formed in the upper surface and an indentation formed in the lower surface, the indentations having a center axis collinear with the longitudinal axis and an interior side wall defining a primary visible surface at an acute angle of view with respect to the longitudinal axis.

18. The hockey puck of claim 17, wherein the indentation has a bottom wall defining a secondary visible surface.

19. The hockey puck of claim 17, wherein the interior side wall is conically shaped and defines an angled surface forming an acute angle with respect to the central axis.

* * * * *